US009551245B2

(12) United States Patent
Shewell et al.

(10) Patent No.: US 9,551,245 B2
(45) Date of Patent: Jan. 24, 2017

(54) TORSION ASSEMBLY FOR CONTROLLABLY PROVIDING TORQUE TO A CAMSHAFT

(71) Applicant: Schaeffler Technologies AG & Co. KG, Herzogenaurach (DE)

(72) Inventors: Jeffrey Shewell, Rochester, MI (US); John Stallmann, Washington, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/789,528

(22) Filed: Jul. 1, 2015

(65) Prior Publication Data

US 2016/0061065 A1 Mar. 3, 2016

Related U.S. Application Data

(60) Provisional application No. 62/041,948, filed on Aug. 26, 2014.

(51) Int. Cl.

| | |
|---|---|
| ***F01L 1/18*** | (2006.01) |
| ***F01L 1/344*** | (2006.01) |
| ***F01L 1/053*** | (2006.01) |
| ***F01L 1/08*** | (2006.01) |
| ***F01L 1/24*** | (2006.01) |
| ***F01L 13/00*** | (2006.01) |

(52) U.S. Cl.

CPC ..... *F01L 1/34409* (2013.01); *F01L 1/053* (2013.01); *F01L 1/08* (2013.01); *F01L 1/181* (2013.01); *F01L 1/185* (2013.01); *F01L 1/2405* (2013.01); *F01L 1/344* (2013.01); *F01L 13/0005* (2013.01); *F01L 2001/34463* (2013.01); *F01L 2105/00* (2013.01); *F01L 2800/01* (2013.01)

(58) Field of Classification Search

CPC ..... F01L 1/053; F01L 1/08; F01L 1/181; F01L 1/344; F01L 1/34409; F01L 13/0005; F01L 2001/34463

USPC ..... 123/90.17, 90.39, 90.45

See application file for complete search history.

(56) References Cited

U.S. PATENT DOCUMENTS

| | | | | |
|---|---|---|---|---|
| 5,107,805 | A | 4/1992 | Butterfield et al. | |
| 7,861,682 | B2 * | 1/2011 | Berger | F01L 1/047 123/495 |
| 2009/0007871 | A1 | 1/2009 | Bugescu et al. | |
| 2009/0107434 | A1 | 4/2009 | Berger | |
| 2012/0067312 | A1 | 3/2012 | Lee | |
| 2012/0222303 | A1 | 9/2012 | Poskie | |

* cited by examiner

*Primary Examiner* — Ching Chang

(74) *Attorney, Agent, or Firm* — Chester Paul Maliszewski

(57) ABSTRACT

A torsion assembly for providing controllable torsion to a camshaft, including: a spring assembly including a first spring; and, a contact element arranged to engage at least one lobe for the camshaft. For a locked mode: the contact element is arranged to be displaced by the at least one cam lobe; the contact element is arranged to compress the first spring; and the first spring is arranged to impart a first torque to the camshaft via the contact element. For an unlocked mode, the contact element is arranged to be displaced by the at least one cam lobe and the contact element is arranged to impart a second torque, less than the first torque, to the cam shaft via the contact element.

16 Claims, 4 Drawing Sheets

TORSION ASSEMBLY FOR CONTROLLABLY PROVIDING TORQUE TO A CAMSHAFT

CROSS-REFERENCE TO RELATED APPLICATIONS

This application claims the benefit under 35 U.S.C. §119 (e) of U.S. Provisional Patent Application No. 62/041,948, filed Aug. 26, 2014, which application is incorporated herein by reference in its entirety.

TECHNICAL FIELD

The present disclosure relates to torsional assembly for controllably providing torque to a camshaft, for example, a camshaft in a vehicular drive train. In particular, the torsional assembly includes a rocker arm, a switchable roller finger follower, or a tappet for engaging with lobes on the camshaft. The lobes are arranged to displace the rocker arm, the finger follower, or the tappet to compress one or two springs to generate and transmit to the camshaft a respective torque associated with compression of the two springs.

In vehicles including an engine with a drive train having a variable cam timing (VCT) system, when the engine is turned off and the camshaft is retarded, the camshaft must be ratcheted to the mid-position when the engine is next started. Further, the ratcheting must be done within a relatively short time span, for example, while an operator is attempting to start the engine. VCT systems with midlock require certain magnitude of torsionals in order to engage the midlock pin, prior to oil pressure reaching a necessary threshold to disengage the pin during normal engine operation. Often start-up torsionals are not enough to engage the pin.

U.S. Pat. No. 5,107,805 discloses an extra cam on a camshaft to increase the magnitude of torsionals during engine operation. The extra cam shaft remains active during normal engine operation. Thus, once the engine is started, the camshaft torsionals are still present. However, the camshaft torsionals are not necessary for operation of the VCT system and can have detrimental effect on other engine components such as higher loads in the valve train, higher chain drive forces, poor chain drive performance, and poor performance in general for any component attached to or operated by the camshaft, such as a fuel pump.

SUMMARY

According to aspects illustrated herein, there is provided a torsion assembly for providing controllable torsion to a camshaft, including: a spring assembly including a first spring; and, a contact element arranged to engage at least one lobe for the camshaft. For a locked mode: the contact element is arranged to be displaced by the at least one cam lobe; the contact element is arranged to compress the first spring; and the first spring is arranged to impart a first torque to the camshaft via the contact element. For an unlocked mode, the contact element is arranged to be displaced by the at least one cam lobe and the contact element is arranged to impart a second torque, less than the first torque, to the cam shaft via the contact element.

According to aspects illustrated herein, there is provided a torsion assembly for providing controllable torsion to a camshaft, including: a first spring with a first spring constant;

a second spring with a second spring constant less than the first spring constant; a lock element including a distal end; and a contact element. For a locked mode: a position of the distal end is fixed; at least one lobe for the camshaft is arranged to displace the contact element; and the displaced contact element is arranged to compress the first spring and transmit a first torque to the camshaft. For an unlocked mode: the at least one lobe for the camshaft is arranged to displace the contact element; and the displaced contact element is arranged to compress the second spring and transmit second torque, less than the first torque, to the camshaft.

According to aspects illustrated herein, there is provided a torsion assembly for providing controllable torsion to a camshaft, including: a housing; a pressure chamber at least partially enclosed by the housing; at least one pin partially disposed in the pressure chamber; a first spring engaged with the at least one pin; a second spring engaged with the housing; a third spring; and a piston engaged with the second and third springs. For a locked mode: the first spring is arranged to displace the at least one pin to block displacement of the piston with respect to the housing; the at least one cam lobe is arranged to displace the housing in the first direction to compress the third spring in the first direction to generate a first torque; and the housing is arranged to transmit the first torque to the camshaft. For an unlocked mode: the pressure chamber is arranged to be pressurized to displace the at least one pin to enable displacement of the housing with respect to the piston; the at least one cam lobe is arranged to displace the housing to compress the second spring in the first direction to generate a second torque, less than the first torque; and the housing is arranged to transmit the second torque to the camshaft.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
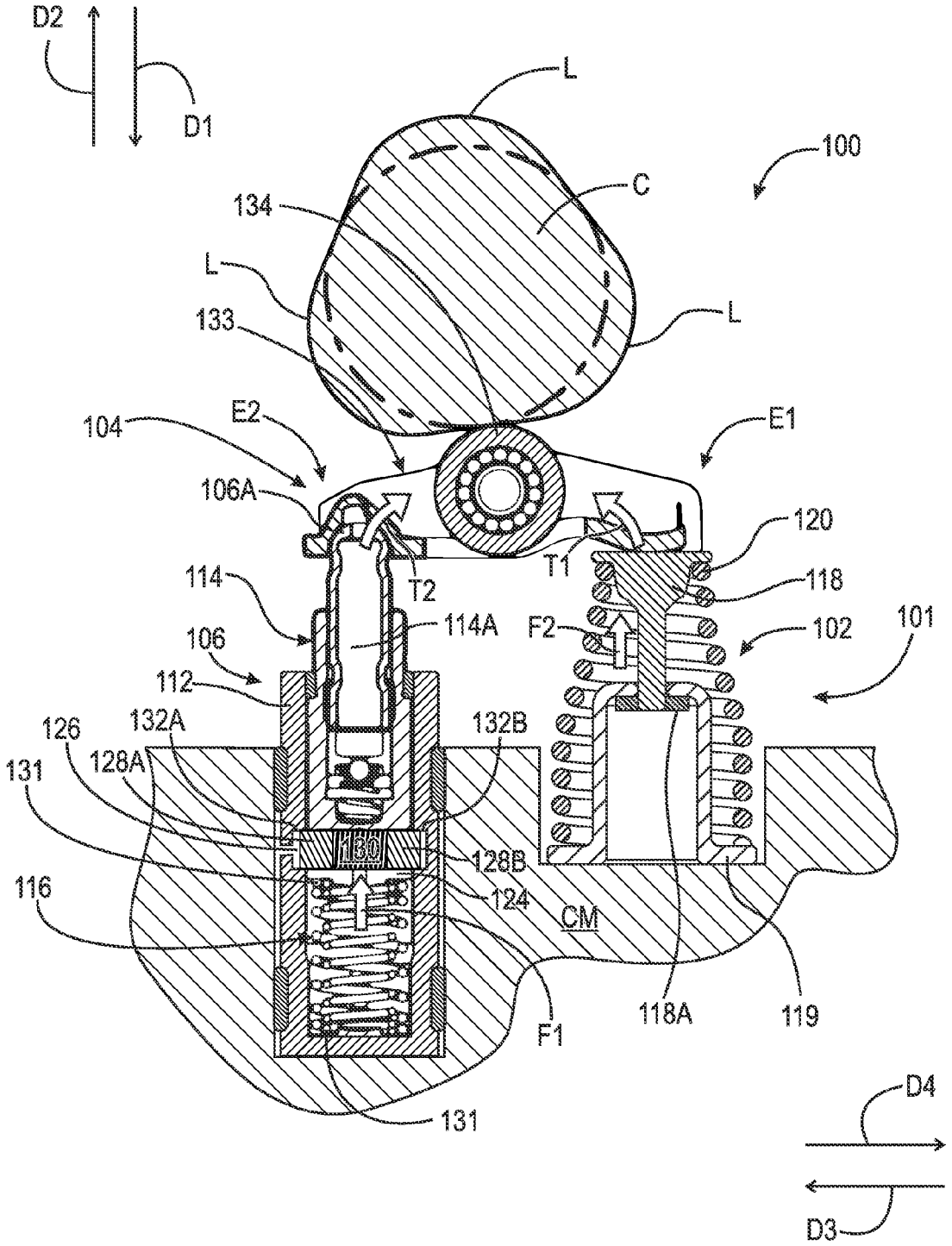
FIG. 1 is a cross-sectional view of a cross-sectional view of a torsion assembly, including a rocker arm, for providing controllable torsion to a camshaft.

FIG. 1 is a cross-sectional view of torsion assembly 100, including a rocker arm, for providing controllable torsion to a camshaft.

Figure 2:
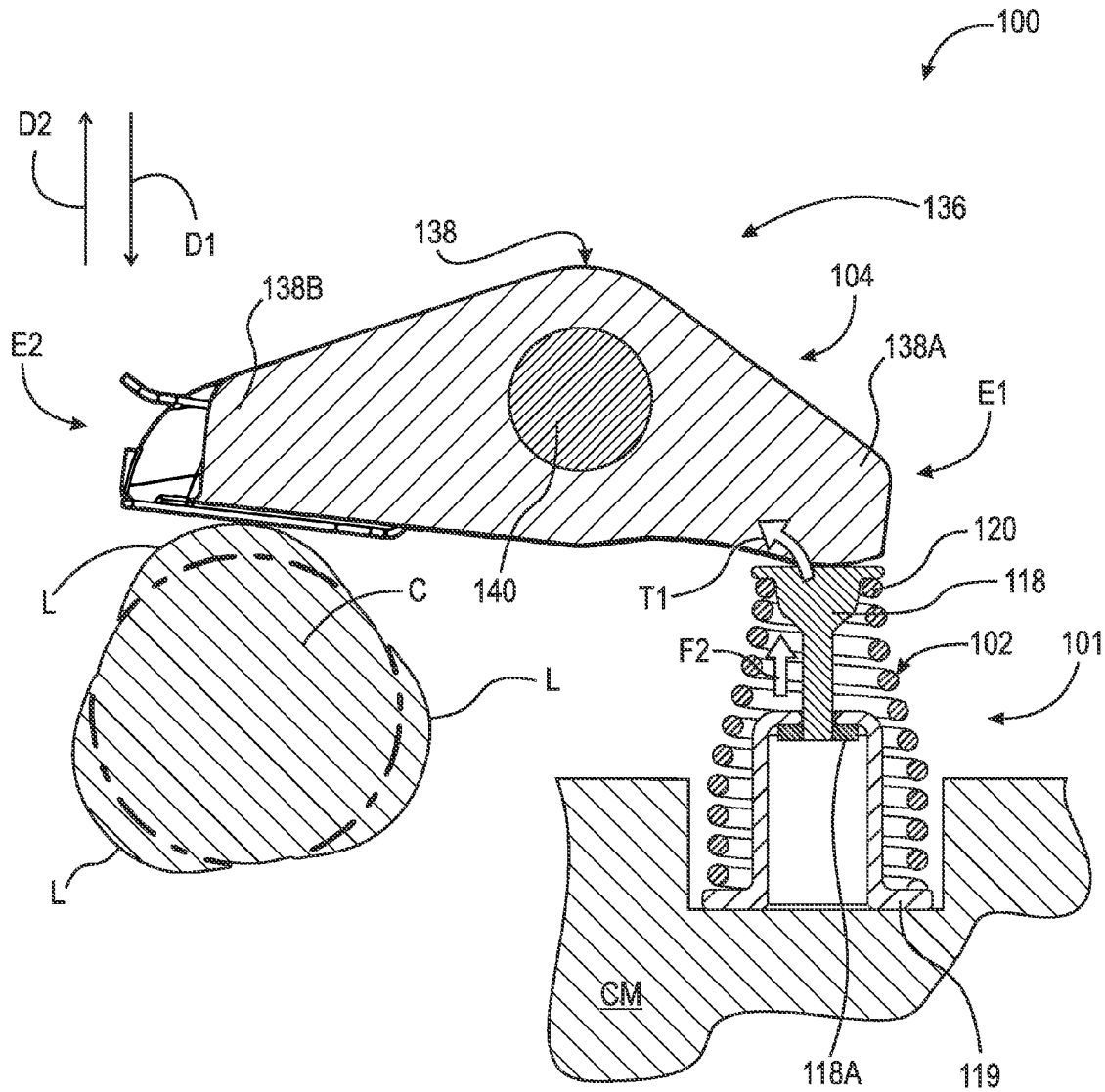
FIG. 2 is a cross-sectional view of a cross-sectional view of a torsion assembly, including a switching roller finger follower, for providing controllable torsion to a camshaft.

FIG. 2 is a cross-sectional view of torsion assembly 100, including a switching finger follower, for providing controllable torsion to a camshaft.

Figure 3:
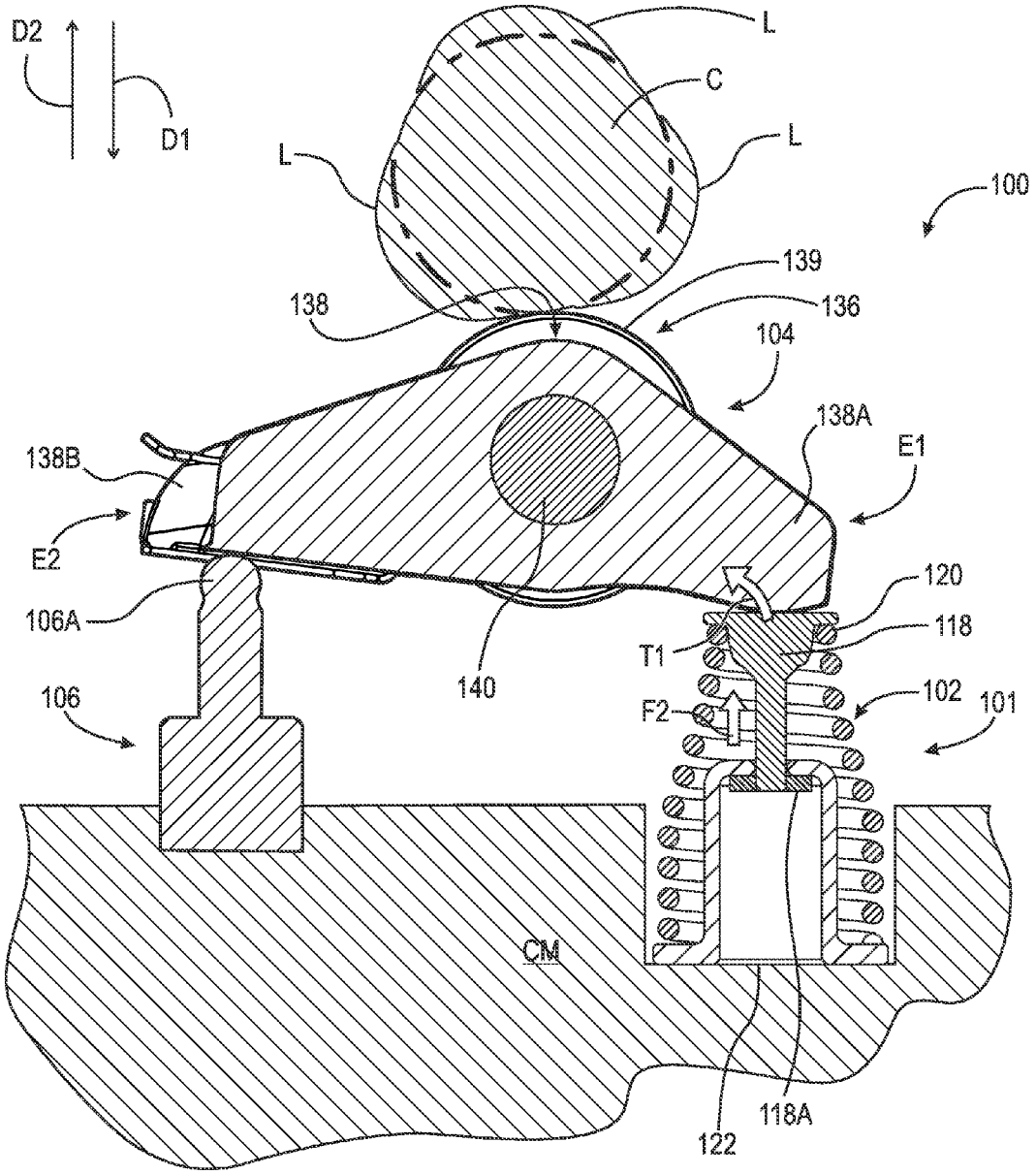
FIG. 3 is a cross-sectional view of a cross-sectional view of a torsion assembly, including a switching roller finger follower, for providing controllable torsion to a camshaft; and, FIG. 4 is a cross-sectional view of a cross-sectional view of a torsion assembly, including a tappet, for providing controllable torsion to a camshaft.

FIG. 3 is a cross-sectional view of torsion assembly 100, including a switching finger follower and a fixed lock element, for providing controllable torsion to a camshaft.

Figure 4:
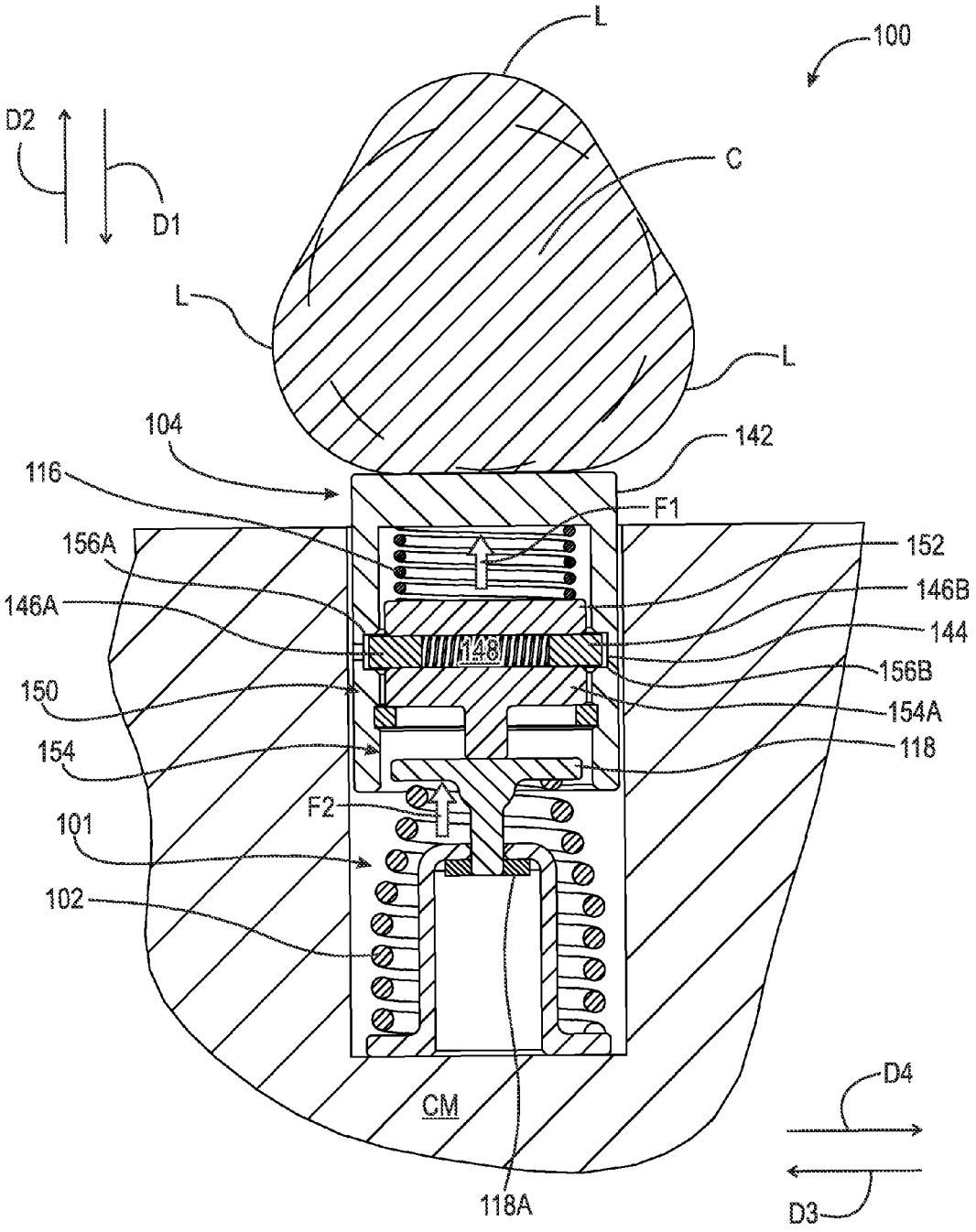

FIG. 4 is a cross-sectional view torsion assembly 100, including tappet, for providing controllable torsion to a camshaft. The following should be viewed in light of FIGS. 1 through 4. Assembly 100 includes spring assembly 101, including spring 102, and contact element 104 arranged to engage at least one lobe L of camshaft C. Hereinafter, "at least one cam lob C" is referred to as "cam lobe C" to simplify presentation. In an example embodiment, contact element 104 is arranged to contact a plurality of lobes L.

For a locked mode, contact element 104 is arranged to be displaced by cam lobe L in direction D1 and element 104 is arranged to compress spring 102 in direction D1. Spring 102 urges at least a portion of element 104 in direction D2; therefore, the resistance of spring 102 to compression in direction D1 imparts torque T1 to lobe L and camshaft C via contact element 104. As camshaft C rotates, lobe L and spring 102 displace end E1 of element 104 in directions D1 and D2 in a cycle.

For an unlocked mode, contact element 104 is arranged to be displaced by cam lobe C and contact element 104 is arranged to impart torque T2, less than torque T1, to cam shaft C via contact element 104. In an example embodiment, spring 102 is free of compression from contact element 104 during the unlocked mode. As camshaft C rotates, lobe L and spring 102 displace end E2 of element 104 in directions D1 and D2 in a cycle.

For a full 360 degree rotation of camshaft C in the locked mode, contact element 104 is arranged to transmit a cumulative torque to the cam shaft. For a full 360 degree rotation of camshaft C in the unlocked mode, the contact element is arranged to transmit a cumulative torque to the cam shaft, which is less than the cumulative torque transmitted by the contact element for a full 360 degree rotation of camshaft C in the locked mode.

In general, torque T2 is much lower than torque T1 and has little or no impact on the operation of camshaft C. In an example embodiment, spring 102 is configured to prevent full compression of spring 102 in the locked mode.

In an example embodiment, assembly 100 includes camshaft C.

The following discussion is directed to the example embodiment shown in FIG. 1. Assembly 100 includes lock element 106. End E1 is engaged with assembly 101 and end E2 is engaged with distal end 106A of lock element 106. For the locked mode, end E2 pivots on lock element 106 and for the unlocked mode, end E1 pivots on assembly 101.

Lock element 106 includes housing 112, component 114, including end 106A, and spring 116. Portion 114A of component 114 is disposed within housing 112. Spring 116 is disposed within housing 112. In an example embodiment, spring 116 urges component 114 in direction D2, opposite direction D1, with force F1 due to preloading of spring 116. F1 increases as spring 116 is compressed. In an example embodiment, spring 116 is not preloaded and force F1 is generated when spring 116 is compressed. End E2 is engaged with end 106A. As further described below, spring 102 provides force F2, greater than F1, in direction D2.

For the locked mode, component 114 is fixed with respect to housing 112 and end E2 pivots on component 114 so that end E1 displaces in direction D1 and compresses spring 102. In an example embodiment, spring 116 is not compressed in the locked mode. In an example embodiment, spring 116 is configured to prevent full compression of spring 116 in the unlocked mode.

For the unlocked mode, end E1 pivots on assembly 101 and component 114 is displaced, with respect to housing 112, by end E2 in direction D1 to compress spring 116. That is, since F1 is less than F2, in response to the displacement of element 104, spring 116 compresses before spring 102 compresses. In an example embodiment, spring 102 is not compressed in the unlocked mode.

In an example embodiment, assembly 101 includes piston 118 partially disposed in housing 119 and engaged with end E1 and end 120 of spring 102 and displaceable in directions D1 and D2. End 122 of spring 102 is arranged to be fixed with respect to cam shaft C. For example, spring 102 is installed in component CM of a valve train including cam shaft C, for example the cylinder head of an internal combustion engine, with end 122 engaged with CM. Piston 118 includes flange 118A which engages housing 119 to limit displacement of piston 118 in direction D2. In an example embodiment, spring 102 is preloaded to exert force F2, greater than F1, in direction D2 on piston 118 and F2 increases as spring 102 is compressed. In an example embodiment, spring 102 is not preloaded and a spring constant for spring 102 is such that as spring 102 is compressed, force F2 is generated.

In an example embodiment, lock element 106 includes piston 124, chamber 126, pins 128A and 128B at least partially disposed in chamber 126, and spring 130. Spring 130 urges pins 128A and 128B in opposite directions D3 and D4, respectively. Piston 124 is engaged with component 114 and end 131 of spring 116. For the locked mode, chamber 126 is substantially unpressurized and spring 130 is arranged to displace pins 128A and 128B directions D3 and D4, respectively, into slots 132A and 132B, respectively in housing 112. The placement of pins 129A and 129B into slots 132A and 132B fixes component 114 and housing 112 together. Movement of component 114 in direction D1 is prevented by pins 129A and 129B, and component 114 becomes a fixed component about which element 104 pivots. For example, a position of component 114, in particular, end 106A, is fixed with respect to camshaft C.

For the unlocked mode, chamber 126 is pressurized to displace pins 128A and 128B directions D4 and D3, respectively, out of slots 132A and 132B, respectively. Component 114, pins 129A and 129B, and piston 124 are now displaceable. The displacement of end E2 in direction D1

Contact element 104 includes rocker arm 132 with bearing 134. Arm 133 includes ends E1 and E2. Bearing 134 is arranged to engage lobe L to minimize frictional losses. Arm 132 is connected to bearing 134 so that bearing 134 and 132 displace in unison in responses to lobe L.

The following discussion is directed to the example embodiment shown in FIG. 2. The description of assembly 101 in FIG. 1 are applicable to assembly 101 in FIG. 2.

In an example embodiment, contact element 104 includes switchable roller finger follower 136 including arm 138, and shaft 140, about which arm 138 is disposed. Portion 138A of arm 138 includes end E1 and portion 138B of arm 138 includes end E2.

For the locked mode, arm 138 is non-rotatably engaged with shaft 140 (arm 138 and shaft 140 are fixed with respect to each other). In response to lobe L, portion 138B of arm 138, is displaced in direction D2 so that arm 138 pivots to compress spring 102 and generate torque T1.

For the unlocked mode, rotation of arm 138 about shaft 140 is enabled. In response to lobe L, portion 138B of arm 138 is displaced in direction D1. Since arm 138 is rotatable about shaft 140, arm 138 rotates with respect to shaft 140 to accommodate the displacement of portion 138B without compressing spring 102. The rotation of arm 138 generates torque T2.

The following discussion is directed to the example embodiment of FIG. 3. The description of assembly 101 in FIG. 1 is applicable to assembly 101 in FIG. 3.

In FIG. 3, contact element 104 includes switchable roller finger follower 136 including arm 138, and shaft 140, about which arm 138 is disposed. Portion 138A of arm 138 includes end E1 and portion 138B of arm 138 includes end E2. Lock element 106 is fixed with respect to component CM, in particular, end 106A is fixed with respect to component CM.

For the locked mode, arm 138 is non-rotatably engaged with shaft 140. In response to lobe L, follower 136, in particular, bearing 139 and arm 138, is displaced in direction D1 so that arm 138 pivots about lock element 106 to compress spring 102 and generate torque T1.

For the unlocked mode, rotation of arm 138 about shaft 140 is enabled. In response to lobe L, bearing 139 is displaced in direction D1. Since arm 138 is rotatable about shaft 140, arm 138 pivots about spring 102 and rotates with respect to shaft 140 to accommodate the displacement of bearing 139 without compressing spring 102. The rotation of arm 138 generates torque T2.

The following discussion is directed to the example embodiment of FIG. 4. The description of spring 116 and assembly 101 in FIG. 1 is applicable to assembly 101 in FIG. 4.

In an example embodiment, for example as shown in FIG. 4, element 104 includes: housing 142; pressure chamber 144 at least partially enclosed housing 142; pins 146A and 146B partially disposed in pressure chamber 144; spring 148 engaged with pins 146A and 146B and urging pins 146A and 146B in opposite directions D3 and D4, respectively; piston 150; spring 102; and spring 116. Spring 116 is engaged with piston 150 and housing 142. Spring 102 is engaged with piston 150 and component CM. In an example embodiment, piston 150 includes component 152 and at least one component 154 and pins 146A and 146B are disposed between component 152 and at least one component 154. Spring 116 is engaged with component 152. In an example embodiment, at least one component 154 includes piston 118 and component 154A. Pins 146A and 146B are disposed between component 152 and component 154A. Piston 118 is engaged with component 154A.

For the locked mode, spring 148 is arranged to displace pins 146A and 146B in opposite directions D3 and D4, respectively, into slots 156A and 156B, respectively, in housing 142 to block displacement of the piston with respect to the housing. The at least one cam lobe L is arranged to displace housing 142 in direction D1 to compress spring 102 in direction D1 and generate torque T1. Housing 142 is arranged to transmit torque T1 to camshaft C.

For the unlocked mode, pressure chamber 144 is arranged to be pressurized to displace pins 146A and 146B in directions D4 and D3, respectively, out of slots 156A and 156B, respectively, to enable displacement of housing 142 with respect to piston 150. The at least one cam lobe L is arranged to displace housing 142 in direction D1 to compress spring 116 in direction D1 and generate torque T2. Housing 142 is arranged to transmit torque T1 to camshaft C. Because force F2 is greater than force F1, spring 102 is not compressed in the unlocked mode unless the spring 116 is fully compressed by housing 142 and housing 142 is displaced in direction D1 after fully compressing spring 116. However, in an example embodiment, element 104 is configured to prevent the fully compression of spring 116.

Advantageously, each of the respective example embodiments in FIGS. 1 through 4 solves the problems, noted above, associated with camshaft torsionals. For example, when extra torsion is needed to ratchet camshaft C, for example, the engine is turned off with the camshaft retarded, assembly 100 is operated in the locked mode, providing torque T1 to the camshaft. For example, when extra torsion is not required, assembly 100 is operated in the unlocked mode, which imparts negligible torque to the camshaft.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A torsion assembly for providing a controllable torsion to a camshaft, comprising:
- a spring assembly including a first spring; and,
- a contact element arranged to engage at least one cam lobe for the camshaft, wherein:
  - for a locked mode:
    - the contact element is arranged to be displaced by the at least one cam lobe;
    - the contact element is arranged to compress the first spring; and,
    - the first spring is arranged to impart a first torque to the camshaft via the contact element; and,
  - for an unlocked mode:
    - the contact element is arranged to be displaced by the at least one cam lobe; and,
    - the contact element is arranged to impart a second torque, less than the first torque, to the cam shaft via the contact element.

2. The torsion assembly of claim 1, wherein the first spring is free of compression from the contact element during the unlocked mode.

3. The torsion assembly of claim 1, further comprising:
- a lock element, wherein:
  - the contact element includes a first end engaged with the spring assembly and a second end engaged with the lock element; and,
  - for the locked mode, the second end of the contact element pivots on the lock element.

4. The torsion assembly of claim 1, wherein:
- the first spring exerts a first force in a first direction, the torsional assembly further comprising:
- a lock element including:
  - a housing;
  - a first component including a portion disposed within the housing; and, a second spring:
disposed within the housing; and,
exerting a first force, in the second direction, less than the first force, wherein:
the contact element includes a first end engaged with the spring assembly and a second end engaged with the first component;
for the locked mode:
the first component is fixed with respect to the housing; and,
the second end of the contact element pivots on the first component to compress the first spring with the first end of the contact element; and,
for the unlocked mode:
the first end of the contact element pivots on the spring assembly; and,
the first component is displaced, with respect to the housing, by the second end of the contact element to compress the second spring.

5. The torsion assembly of claim 4, wherein the second spring is free of compression during the locked mode.

6. The torsion assembly of claim 4, wherein:
the lock element includes a pressure chamber;
for the locked mode, the pressure chamber is pressurized with a fluid to fix the first component with respect to the housing for the lock element; and,
for the unlocked mode, at least a portion of the fluid is drained from the pressure chamber to enable the first component to displace with respect to the housing for the lock element to compress the second spring.

7. The torsion assembly of claim 4, wherein the contact element includes:
a bearing arranged to engage the at least one cam lobe; and,
an arm engaged with the bearing and including the first and second ends.

8. The torsion assembly of claim 1, further comprising:
a lock element including a non-displaceable distal end, wherein:
the contact element includes a switching roller finger follower, the switching roller finger follower including:
a bearing arranged to contact the at least one cam lobe; and,
an arm:
connected to the bearing;
disposed about a shaft; and
including:
a first portion with a first end engaged with the spring assembly; and,
a second portion including a second end engaged with the distal end of the lock element, wherein:
for the locked mode:
the bearing is arranged to be displaced by the at least one cam lobe;
the arm is arranged to non-rotatably connect to the shaft;
the second end is arranged to pivot on the distal end; and,
the first end is arranged to compress the first spring; and,
for the unlocked mode:
the bearing is arranged to be displaced by the at least one cam lobe;
rotation of the arm with respect to the shaft is enabled;
the arm is arranged to rotate with respect to the shaft;
the first end is arranged to pivot on the spring assembly; and,
the second end is arranged to compress the second spring.

9. The torsion assembly of claim 8, wherein for the unlocked mode, the first spring is not compressed.

10. The torsion assembly of claim 1, wherein:
the contact element includes a switching roller finger follower;
the switching roller finger follower includes an arm disposed about a shaft;
the arm includes:
a first end engaged with the spring assembly; and,
a second end arranged to engage the at least one cam lobe for the camshaft;
for the locked mode:
the arm is arranged to non-rotatably connect to the shaft;
the at least one cam lobe for the camshaft is arranged to displace the second end; and,
the first end is arranged to compress the first spring; and,
for the unlocked mode:
the at least one cam lobe for the camshaft is arranged to displace the second end; and,
the arm is arranged to rotate about the shaft.

11. The torsion assembly of claim 1, wherein:
the contact element includes:
a housing;
a pressure chamber at least partially enclosed by the housing;
at least one pin partially disposed in the pressure chamber;
second and third springs; and,
a piston engaged with the first and second springs;
the first spring is engaged with the piston;
the second spring is engaged with the housing and the piston;
for the locked mode:
the third spring is arranged to displace the at least one pin to block displacement of the piston with respect to the housing; and,
the at least one cam lobe is arranged to displace the housing to:
displace the piston;
compress the first spring in the first direction; and,
generate a first torque; and,
for the unlocked mode:
the pressure chamber is arranged to be pressurized to displace the at least one pin;
the at least one cam lobe is arranged to displace the housing in the first direction to:
compress the second spring in the first direction; and,
generate the second torque.

12. The torsion assembly of claim 1, wherein:
for a full 360 degree rotation of the camshaft in the locked mode, the contact element is arranged to transmit a first cumulative torque to the cam shaft; and,
for a full 360 degree rotation of the camshaft in the unlocked mode, the contact element is arranged to transmit a second cumulative torque, less than the first cumulative torque, to the cam shaft.

13. A torsion assembly for providing a controllable torsion to a camshaft, comprising:
a first spring preloaded to exert a first force in a first direction;

a second spring preloaded to exert a second force, less than the first force, in the first direction;

a lock element including a distal end; and, a contact element, wherein:

for a locked mode:

a position of the distal end is fixed;

at least one lobe for the camshaft is arranged to displace the contact element; and, the displaced contact element is arranged to:

compress the first spring; and, transmit a first torque to the camshaft; and, for an unlocked mode:

the at least one lobe for the camshaft is arranged to displace the contact element; and, the displaced contact element is arranged to:

compress the second spring; and, transmit a second torque, less than the first torque, to the camshaft.

14. The torsion assembly of claim 13, further comprising:

a spring assembly including the first spring, wherein:

the lock element includes:

a housing arranged to be fixed with respect to the cam shaft;

a pressure chamber at least partially formed by the housing; and, a component at least partially disposed in the pressure chamber and including the distal end;

the second spring is disposed within the pressure chamber;

the contact element includes an arm with first and second ends;

the first end is engaged with the spring assembly;

the second end is engaged with the component;

for the locked mode:

the pressure chamber is arranged to be filled with a pressurized fluid to fix a position of the first component with respect to the housing and to prevent compression of the second spring;

the second end is arranged to pivot on the distal end; and, the first end is arranged to compress the first spring; and, for the unlocked mode:

the pressure fluid is arranged to be drained from the pressure chamber;

the first end is arranged to pivot on the spring assembly; and, the second end is arranged to compress the second spring.

15. The torsion assembly of claim 13, further comprising:

a spring assembly including the first spring, wherein:

the contact element includes a switching roller finger follower;

the switching roller finger follower includes an arm disposed about a shaft;

the arm includes:

a first end engaged with the spring assembly; and, a second end arranged to engage the at least one lobe for the camshaft;

for the locked mode:

the arm is arranged to non-rotatably connect to the shaft;

the at least one lobe for the camshaft is arranged to displace the second end; and, the first end is arranged to compress the first spring; and, for the unlocked mode:

the at least one lobe for the camshaft is arranged to displace the second end, and, the arm is arranged to rotate about the shaft.

16. The torsion assembly of claim 13, wherein:

for a full 360 degree rotation of the camshaft in the locked mode, the contact element is arranged to transmit a first cumulative torque to the cam shaft; and, for a full 360 degree rotation of the camshaft in the unlocked mode, the contact element is arranged to transmit a second cumulative torque, less than the first cumulative torque, to the cam shaft.

* * * * *